US008469677B1

(12) United States Patent
Gandrud

(10) Patent No.: US 8,469,677 B1
(45) Date of Patent: Jun. 25, 2013

(54) CHECK VALVE PUMP WITH ELECTRIC BYPASS VALVE

(75) Inventor: Michael D. Gandrud, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 1208 days.

(21) Appl. No.: 11/865,243

(22) Filed: Oct. 1, 2007

(51) Int. Cl.
*F04B 1/12* (2006.01)
*F04B 27/08* (2006.01)

(52) U.S. Cl.
USPC ..... 417/269; 417/222.1

(58) Field of Classification Search
USPC ..... 417/269, 222.1, 303, 304, 307; 60/494
See application file for complete search history.

(56) References Cited

U.S. PATENT DOCUMENTS

| | | | | |
|---|---|---|---|---|
| 2,928,243 | A | 3/1958 | Albright | |
| 3,178,888 | A * | 4/1965 | Hampton | 60/484 |
| 3,679,328 | A * | 7/1972 | Cattanach | 417/270 |
| 3,692,052 | A * | 9/1972 | Cattanach | 137/561 R |
| 4,041,703 | A * | 8/1977 | Knapp | 60/464 |
| 4,576,554 | A * | 3/1986 | Wagenseil et al. | 417/270 |
| 4,801,247 | A | 1/1989 | Hashimoto et al. | |
| 4,957,329 | A | 9/1990 | Matsuda | |
| 5,190,446 | A * | 3/1993 | Salter et al. | 417/297 |
| 5,259,738 | A | 11/1993 | Salter et al. | |
| 5,338,160 | A | 8/1994 | Thurner | |
| 5,456,581 | A * | 10/1995 | Jokela et al. | 417/282 |
| 5,464,328 | A * | 11/1995 | Stoeger | 417/44.8 |
| 5,647,266 | A * | 7/1997 | Claas | 92/71 |
| 5,699,714 | A * | 12/1997 | Jung et al. | 91/439 |
| 6,030,182 | A * | 2/2000 | Voigt | 417/222.1 |
| 6,345,501 | B1 * | 2/2002 | McKay et al. | 60/468 |
| 6,447,263 | B1 * | 9/2002 | Cooke et al. | 417/297 |
| 6,651,545 | B2 * | 11/2003 | Nippert | 91/476 |
| 6,681,571 | B2 | 1/2004 | Bailey et al. | |
| 6,739,127 | B2 | 5/2004 | Nippert et al. | |
| 7,210,566 | B2 * | 5/2007 | Baxter, Jr. | 192/35 |
| 2008/0080985 | A1 * | 4/2008 | Gray et al. | 417/222.1 |

FOREIGN PATENT DOCUMENTS

| | | |
|---|---|---|
| JP | 62292568 | 12/1987 |
| JP | 63192998 | 8/1988 |
| JP | 2005282456 | 4/2007 |

* cited by examiner

*Primary Examiner* — Devon Kramer
*Assistant Examiner* — Amene Bayou
(74) *Attorney, Agent, or Firm* — Zarley Law Firm, P.L.C.

(57) ABSTRACT

A hydraulic power unit having a power shaft that rotates a cam. The cam actuates a piston assembly that contains a plurality of pistons wherein each piston has a piston body and fluid working chamber. An electrically actuated bypass valve is fluidly connected and in communication between an outlet check valve and a fluid working chamber of each piston such that when actuated the electrically actuated bypass valve directs fluid away from the outlet port into a reservoir to be returned to an inlet port.

8 Claims, 3 Drawing Sheets

CHECK VALVE PUMP WITH ELECTRIC BYPASS VALVE

BACKGROUND OF THE INVENTION

This invention relates to a hydraulic power unit. More specifically this disclosure relates to a hydraulic power unit that uses an electrically actuated bypass valve to redirect fluid from an outlet to an inlet.

Naturally commutated hydraulic power pumps are known in the prior art. Such pumps are also referred to as check valve hydraulic pumps or wobble plate hydraulic pumps. Adjustable displacement hydraulic power pumps have many benefits versus fixed displacement power pumps. For example, a hydraulic pump may receive mechanical energy from a mechanical power means such as an internal combustion engine, turbine, electric motor or the like. Hydraulic power pumps typically convert rotational mechanical energy to hydraulic fluid power that is used to actuate a hydraulic machine in order to accomplish some useful or desirable function.

Hydraulic power pumps are commonly connected to a hydraulic motor, hydraulic cylinder, or the like. Such hydraulic actuators are used to turn the wheels or other propulsion means of a vehicle, to lift, manipulate or otherwise position a heavy load, or for similar type purposes.

Various mechanisms are used to adjust the volume of fluid displaced per revolution of a mechanical power input shaft. Specifically, conventional displacement adjustment mechanisms used in piston pumps adjust the distance that each piston reciprocates for each revolution of a power shaft, thereby causing an adjustment in the volume of the fluid that is displaced by such a piston. Such conventional displacement adjusting mechanisms generally suffer from a high part count, difficult assembly processes, high cost, precisely machined part tolerances, poor efficiency, and other problems that are well know in the art.

Another attempted solution is seen in U.S. Pat. No. 5,190,449 to Stalter et al. The Stalter reference teaches a novel mechanism that accomplishes adjustable displacement without the need to adjust the distance that pistons reciprocate. The Stalter mechanism uses electromechanical valves to electrically or synthetically commutate the opening and closing of the inlet check valves and optionally the outlet check valves.

In the simplest embodiment of the Stalter mechanism an electromechanical inlet valve will be actuated open and closed at the appropriate phases of shaft rotation as required for each shaft revolution to determine if the fluid displacement by a piston reciprocation is displaced through an outlet valve or in a reversed direction through an inlet check valve that is adapted to be electrically held in an open position. While the Stalter mechanism holds promise for the future, to date, there have been no known commercial applications of the Stalter mechanism. To date, embodiments of the Stalter mechanism have suffered from bulky dimensions, high complexity of operation, and high cost.

Thus, it is a principal object of the present invention to provide an improved and simplified adjustable displacement hydraulic pump.

Yet another object of the present invention is to provide an adjustable displacement hydraulic power unit that operates with improved efficiency.

It is yet another object of the present invention to provide a more compact adjustable displacement hydraulic power unit.

These and other objects, features, or advantages of the present invention will become apparent from the specification and claims.

BRIEF SUMMARY OF THE INVENTION

A hydraulic power unit having a power shaft that is secured to a cam wherein the power shaft rotates said cam. A piston assembly contacting the cam and having at least one piston body that reciprocates within a fluid working chamber as a result of the rotation of the cam. The hydraulic power unit also has an inlet port that is fluidly connected to a fluid working chamber through an inlet check valve, and an outlet fluid port that is fluidly connected to the fluid working chamber through an outlet check valve. An electrically actuated bypass valve is fluidly connected between the inlet port and either the fluid working chamber or an outlet manifold wherein when actuated the electrically actuated bypass valve directs fluid away from the outlet port into a reservoir to be taken to an inlet reservoir.

DETAILED DESCRIPTION OF THE PREFERRED EMBODIMENT

Figure 1:
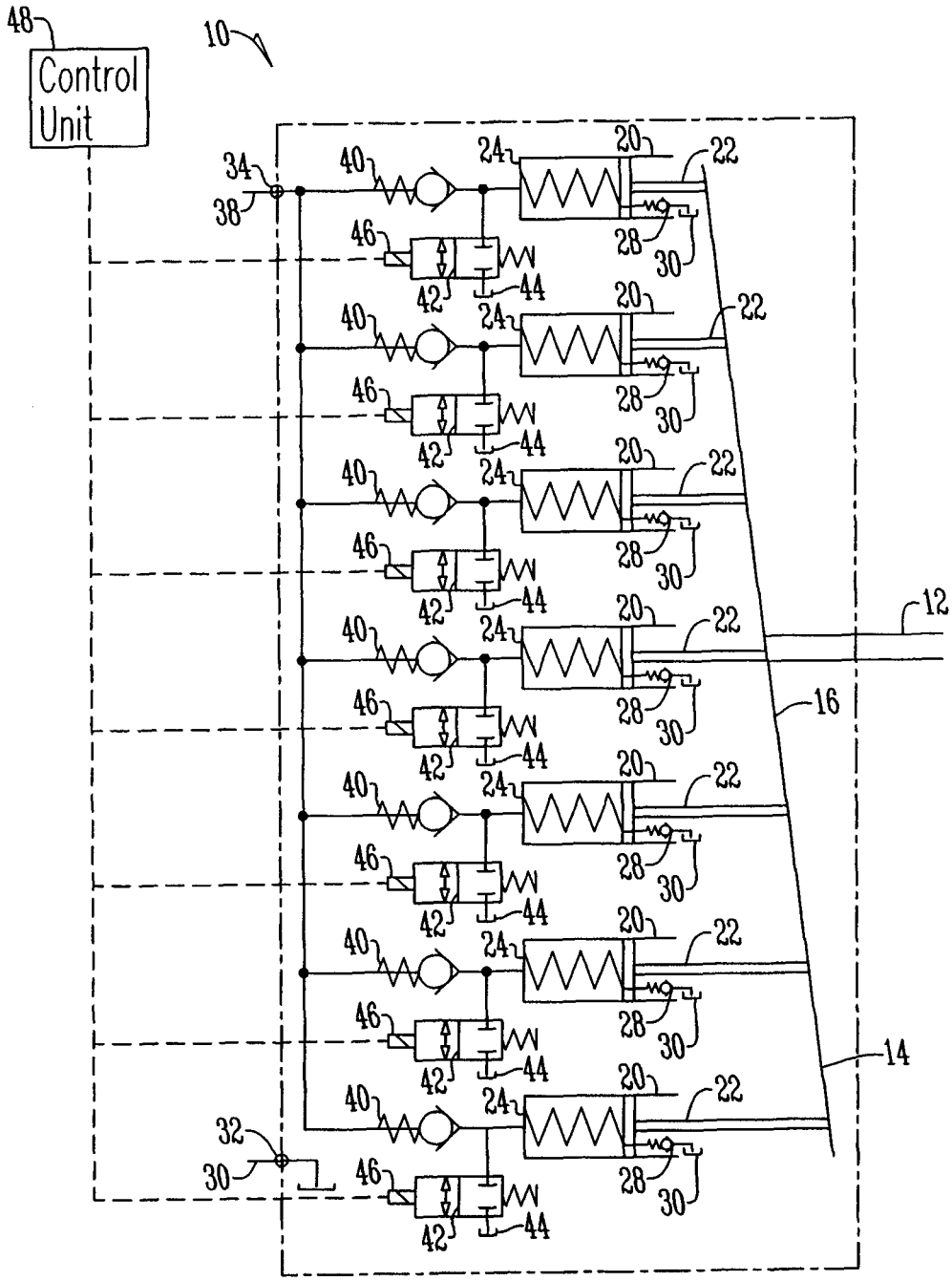
FIG. 1 is a schematic view of a hydraulic power unit.

FIG. 1 shows a first embodiment of a hydraulic power unit 10. In this embodiment the hydraulic power unit 10 is shown as an adjustable displacement pump. The hydraulic power unit 10 has a power shaft 12 that is secured to a cam 14. The cam 14 has at least one cam surface 16. Thus, as the power shaft 12 rotates the cam 14 additionally rotates.

In engagement with and actuated by cam 14 is a cylinder block assembly 18. The cylinder block assembly 18 has a plurality of cylinders 20 therein with each cylinder bore containing a piston body 22 that reciprocates within a fluid working chamber 24. In one embodiment each of the piston bodies 22 is swivably connected to a slipper 26 for engagement with the cam 14. Disposed within each piston body 22 is an inlet check valve 28 that in this embodiment is shown as a check ball. Additionally, each inlet check valve 28 of the piston assembly 18 is fluidly connected to a reservoir 30 within the hydraulic power unit 10.

Each hydraulic power unit additionally has an inlet port 32 and an outlet port 34 that are both fluidly connected to the piston assembly 18 and each lead to an inlet reservoir 30 and an outlet manifold 38 respectively. Specifically, the inlet reservoir 30 preferably comprises the cavity around the cam 14 and between the pistons 22 within the housing of the pump 10.

In the embodiment as shown in FIG. 1, each of the cylinder bores 20 of the cylinder block assembly 18 is associated with an outlet check valve 40. In this embodiment the valves 40 are shown as check ball valves. Additionally, an electrically actuated bypass valve 42 is positioned between the check valve 40 and the fluid working chamber 24 of the cylinder bore 20 such that when actuated fluid is directed away from the outlet port 34 into a reservoir 44 to be taken to the inlet reservoir 30. In a preferred embodiment the electrically actuated bypass valve 42 contains a solenoid 46 and is considered a solenoid valve. Additionally, electrically connected to the electrically actuated bypass valve 42 is a control unit 48 that controls the actuation of the electrically actuated bypass valve 42.

Figure 2:
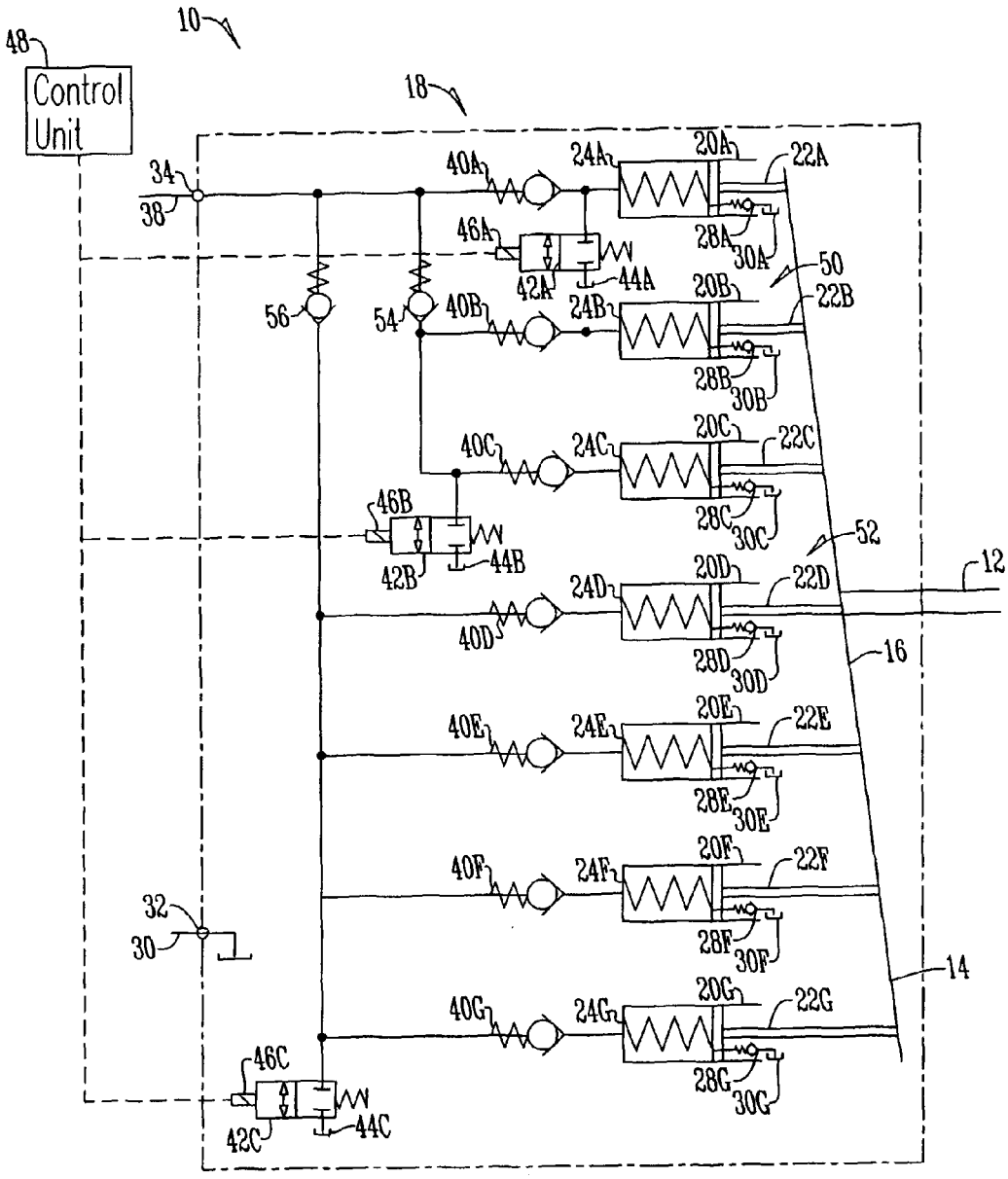
FIG. 2 is a schematic view of a hydraulic power unit.
Figure 3:
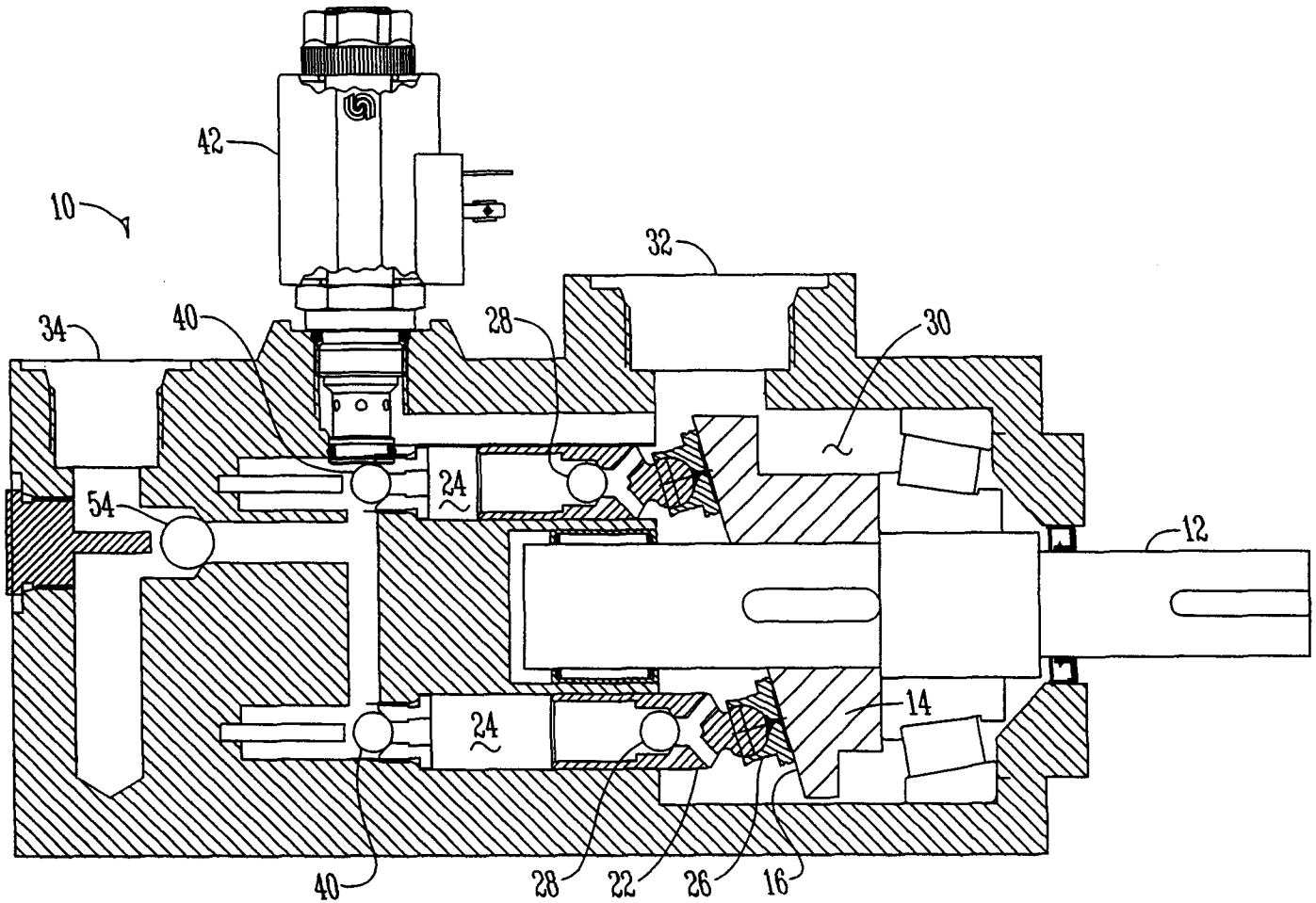
FIG. 3 is a cross sectional view of a section of the hydraulic power unit shown in FIG. 2.

The embodiment of the hydraulic power unit 10 shown in FIGS. 2 and 3 eliminates the need for an electrically actuated bypass valve 42 for each individual piston 20. Instead, in this embodiment an electrically actuated bypass valve 42 can control the fluid flow of a plurality of pistons 20. Specifically, in the arrangement a first piston 20A is arranged in communication with an electrically actuated bypass valve 42 and a check valve 40 as is shown in FIG. 1. However, the remaining cylinder bores 20B through 20G are grouped into separate sets 50 and 52 wherein both the first set 50 and the second set 52 contain a plurality of pistons therein.

In this arrangement the first set 50 contains second and third cylinder bores 20B and 20C that are fluidly connected to second and third outlet check valves 40B and 40C similarly to how the first piston 20A is connected to the first check valve 40A. However, instead of placing the electrically actuated bypass valve in between and in fluid communication with the working chamber and the check valve, when a plurality of pistons is provided in a set, the electrically actuated bypass valve is placed in between the outlet check valves and the outlet port 34. Specifically, in the first set 50 the second electrically actuated bypass valve 42B is placed in fluid communication and in between the second and third check valves 40B and 40C and the outlet port 34. Thus, when the second electrically actuated bypass valve 42B is actuated the valve directs fluid away from the outlet port 34 and into a second reservoir 44B. In this arrangement a first unit check valve 54 can be placed in fluid communication and in between the second electrically actuated bypass valve 42B and the outlet port 34 to prevent undesirable reverse flows.

Similarly, a second set 52 can be added to the hydraulic power unit 10. In the embodiment as shown in FIG. 2 the second set 52 contains four pistons; fourth, fifth, sixth, and seventh pistons 20D, 20E, 20F, and 20G. Just as with the first set each piston 20D-20G has a fluid working chamber 24D-24G that is in communication with a check valve 40D-40G wherein a third electrically actuated bypass valve 42C is placed fluidly in communication and between the check valves 40D-40G and the outlet port 34. Thus, similar to the operation of the first set 50 when actuated the third electrically actuated bypass valve 42C directs fluid from the fluid working chambers of pistons 20D-20G away from the outlet port 34 and toward a third reservoir 44C. Like with the first set 50, the second set 52 comprises a second unit check valve 56 that is in fluid communication between the third electrically actuated bypass valve 42C and the outlet port 34 to prevent undesirable reverse flows.

Though FIG. 2 shows the pistons are arranged in groups of one, two, and four one skilled in the art will appreciate that any number of sets of pistons could be added to the hydraulic power unit in a similar manner. Additionally, the amount of pistons (two, four) may be altered such that a set has three, five, six or more pistons therein that are in communication with an electrically actuated bypass valve. Thus, by using a control unit 48 that senses the operation of the hydraulic power unit the plurality of electrically actuated bypass valves 42A-42C may be selectively and sequentially actuated in response to demands on the hydraulic power unit to provide an optimum operating condition.

In operation the hydraulic power unit 10 operates wherein the shaft 12 turns causing the cam 14 to rotate thus causing the plurality of pistons 20 to selectively reciprocate into and out of their respective fluid working chambers 24. As the piston assembly 18 reciprocates out of their fluid working chambers 24, fluid flows through the inlet check valve 28 of the piston 20 into the fluid working chamber 24. As the piston 20 reciprocates into its fluid working chamber 24, fluid is expelled from the chamber selectively through the outlet check valve 40 and to the pump outlet port 34 and onto the outlet manifold 38. Alternatively, fluid flows though the electrically actuated bypass valve 42 back to the inlet reservoir 30 via a reservoir 44. Inlet reservoir 30 and reservoir 44 are optionally separate reservoirs or the same reservoir.

By opening the electrically actuated bypass valve 42 fluid is displaced by contraction from a fluid working chamber 24 causing fluid to be directed away from flow through the outlet check valve 40 or to the outlet port 34 and causes the fluid to return to the inlet fluid reservoir 30. By closing the electrically actuated bypass valve 42 fluid displaced by contraction of a fluid working chamber 24 is caused to flow through the outlet check valve 40 and into the power unit outlet port 34 and not return flow through the electrically actuated bypass valve 42 or return to the pump inlet manifold 36.

A plurality of piston valvetrain assemblies as described is preferably disposed within a housing of the hydraulic power unit 10 as described. An external controller or control unit 48 receives a displacement command comprising an instruction of how many of the plurality of electrically actuated bypass valves 42 should be energized to select the number of fluid working chambers 24 that displace fluid to a hydraulic power unit outlet port 34 and how many electrically actuated bypass valves 42 are to displace fluid back to the fluid inlet manifold 36.

When the hydraulic power unit of FIG. 2 is operated the first electrically actuated bypass valve 42A is arranged to selectively bypass the fluid displaced from a single fluid working chamber 24 whereas second and third electrically actuated bypass valves 42B and 42C are arranged to bypass fluid from a plurality of working chambers 24B-24G. Consequently, by actuating the first, second and third electrically actuated bypass valves 42A-42C one can select any integer number of fluid working chambers (0-7 in the example shown in FIG. 2) that displace fluid to the outlet port 34. First and second unit check valves 54 and 56 are then added to prevent undesirable reverse flows of hydraulic fluid.

Thus, disclosed is a hydraulic power unit that eliminates the high cost and complexities associated with rapid operating actuatable check valves and replaces these actuatable check valves with simple natural commutating check valves. To accomplish the function of bypassing fluid to the inlet manifold simple, low cost and slow operating electrically actuated valves are used. The electrically operated valves have the advantage of low cost and simple construction and in slower speed operations such as driving an engine cooling fan provides needed desire to control the hydraulic power unit 10. Thus, at the very least all of the stated objectives have been met.

It will be appreciated by those skilled in the art that other various modifications could be made to the device without the parting from the spirit in scope of this invention. Persons skilled in the art will see that the present invention can be embodied as an axial piston pump as shown in FIG. 3, as a radial piston pump, or with pistons disposed in any angle ranging from axial to radial thus comprising a conical axis pump. The present invention also contemplates that electrically actuated solenoid valves 46, 46A, 46B, 46C could alternatively be electrically actuated piezoelectric valves without departing from the spirit of the present invention. All such modifications and changes fall within the scope of the claims and are intended to be covered thereby.

What is claimed is:

1. A hydraulic power unit comprising:

a power shaft;

a cam secured to the power shaft for rotation of the cam;

a piston assembly contacting the cam and having a first piston body that reciprocates within a first fluid working chamber;

an inlet and an outlet port in fluid communication with the first fluid working chamber wherein the inlet port is fluidly connected to an inlet reservoir which comprises a cavity around the cam and the first piston body within a housing of the power unit;

a first check valve in fluid communication with the first fluid working chamber and the outlet port; and a first electrically actuated bypass valve fluidly connected between the first check valve and the first fluid working chamber such that fluid displaced from the first fluid working chamber is selectively expelled from either the first fluid working chamber to the outlet port or to the inlet reservoir in response to the actuation of the first electrically actuated bypass valve;

wherein the piston assembly further comprises second and third piston bodies wherein the second piston body reciprocates within a second fluid working chamber and the third piston body reciprocates within a third fluid working chamber;

a second check valve in fluid communication with the second fluid working chamber and the outlet port;

a third check valve in fluid communication with the third fluid working chamber and the outlet port;

a first unit check valve within the hydraulic power unit positioned to prevent reverse fluid flow from the outlet port towards second and third fluid working chambers;

a second electrically actuated bypass valve fluidly connected between the third check valve and the first unit check valve wherein when activated directs fluid away from the outlet port and toward the inlet port.

2. The hydraulic power unit of claim 1 wherein the second fluid working chamber has an inlet check valve associated therewith.

3. The hydraulic power unit of claim 1 wherein the electrically actuated bypass valves are solenoid valves.

4. The hydraulic power unit of claim 1 wherein the second and third piston bodies form a first set of pistons.

5. The hydraulic power unit of claim 4 further comprising a second set of pistons that comprise a plurality of piston bodies within a plurality of working chambers;

wherein each working chamber is fluidly connected to a separate check valve; and wherein every check valve is fluidly connected to a second unit check valve that prevents reverse fluid flow from the outlet port.

6. The hydraulic power unit of claim 5 further comprising a third electrically actuated bypass valve fluidly connected between a fluid chamber in the second set of pistons and the second unit check valve wherein when activated directs fluid away from the outlet port and toward the inlet port.

7. The hydraulic power unit of claim 1 wherein the electrically actuated bypass valves are piezoelectric valves.

8. The hydraulic power unit of claim 1 wherein the first piston body has a second check valve disposed therein.

* * * * *